US006281637B1

(12) United States Patent
Asada

(10) Patent No.: US 6,281,637 B1
(45) Date of Patent: Aug. 28, 2001

(54) PIEZOELECTRIC TRANSFORMER AND DISCHARGE LAMP DEVICE

(75) Inventor: Takaaki Asada, Moriyama (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/539,694

(22) Filed: Mar. 31, 2000

(30) Foreign Application Priority Data

Apr. 22, 1999 (JP) ..... 11-114673

(51) Int. Cl.[7] ..... H05B 37/02

(52) U.S. Cl. ..... 315/209 PZ; 315/276; 315/282; 310/314; 310/316.01; 310/318

(58) Field of Search ..... 315/209 PZ, 209 R, 315/276, 282, 224; 310/314, 316.01, 318, 319, 359

(56) References Cited

U.S. PATENT DOCUMENTS 5,705,879 * 1/1998 Abe et al. ..... 310/359
5,923,542 * 7/1999 Saskai et al. ..... 363/16
5,923,546 * 7/1999 Shimada et al. ..... 363/40
6,028,398 * 2/2000 Kawasaki et al. ..... 315/224

FOREIGN PATENT DOCUMENTS 10-125970 5/1998 (JP) .
10-144484 5/1998 (JP) .
10-150230 6/1998 (JP) .

* cited by examiner

*Primary Examiner*—Haissa Philogene
(74) *Attorney, Agent, or Firm*—Ostrolenk, Faber, Gerb & Soffen, LLP

(57) ABSTRACT

The output impedance of a piezoelectric transformer defined as a value obtained by dividing the output current at a load resistance of about zero into the output voltage at a load resistance of about infinity is set to be larger than about one-third of the maximum impedance of a discharge tube during discharging. Further, the absolute value of the gradient of the characteristic curve of the piezoelectric transformer is set to be smaller than the absolute value of the gradient of the output characteristic curve of a discharge lamp.

4 Claims, 7 Drawing Sheets

FIG. 7
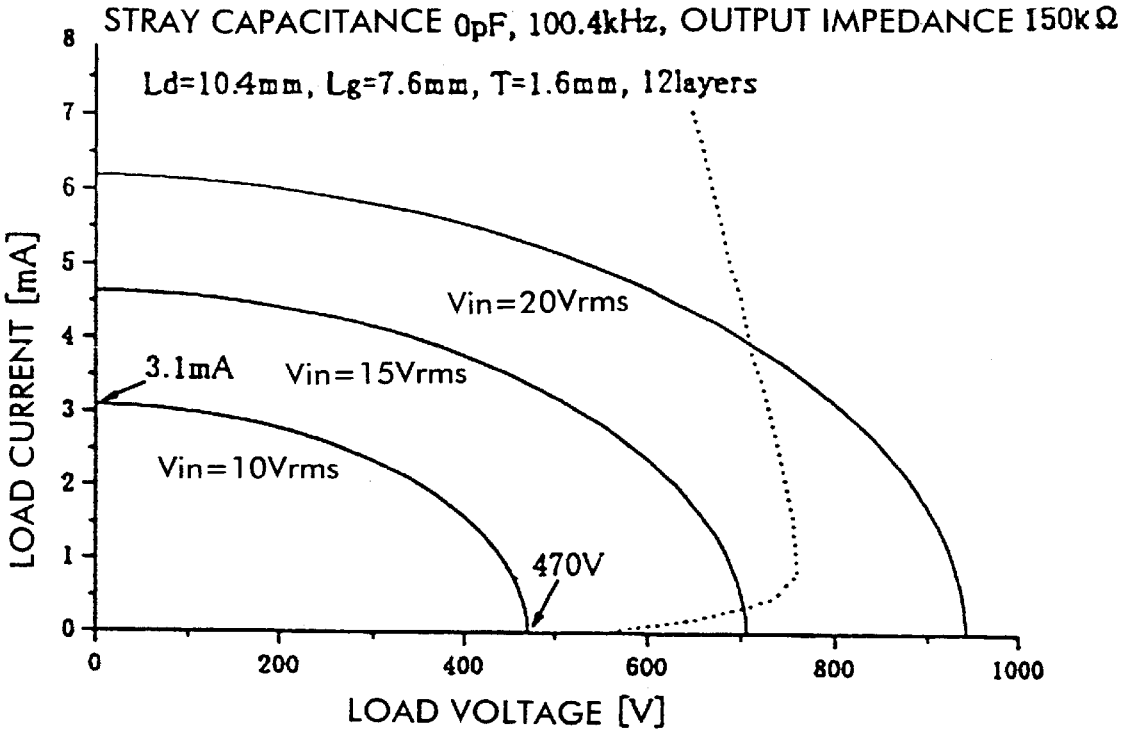
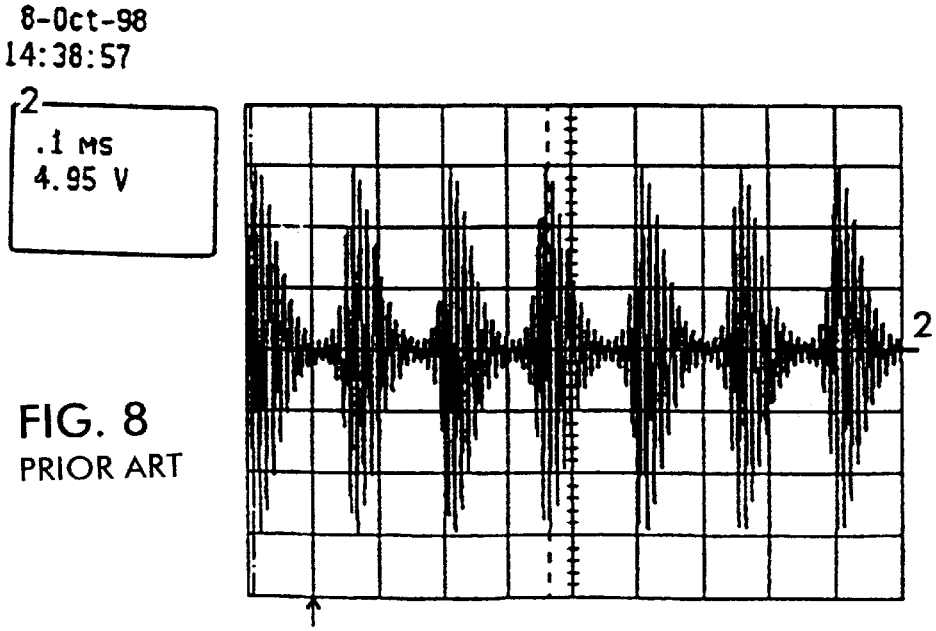
FIG. 8
PRIOR ART

PIEZOELECTRIC TRANSFORMER AND DISCHARGE LAMP DEVICE

BACKGROUND OF THE INVENTION

1. Field of the Invention

The present invention relates to a piezoelectric transformer for driving a discharge tube such as a cold-cathode tube or the like for use as the back light of a liquid crystal display or the like, and a discharge lamp device including the same.

2. Description of the Related Art

Cold-cathode tubes for use as a light source for the back light of a liquid crystal display have a high impedance of several MΩ when they are lit, and require a high voltage of at least 1 kV. The impedance while they are lit is decreased to about dozen kΩ to several hundred kΩ, and they are driven at a several hundred volts. Conventionally, as a high voltage source for driving such a discharge tube, a piezoelectric transformer which can be easily reduced in size and for which the required power can be simply reduced has been used.

FIG. 11 shows an example of the piezoelectric transformer, which is a so-called Rosen type piezoelectric transformer, and makes use of a primary longitudinal vibration mode in the longitudinal direction. As regards the constitution of the piezoelectric transformer, an input voltage is applied across input electrodes 2*a* and 2*b* through terminals IN-GND on the input side. An output voltage boosted and generated at an output electrode, caused by the piezoelectric effect and the inverse piezoelectric effect, is output through terminals OUT-GND on the output side.

However, when a cold-cathode tube is connected directly to such a piezoelectric transformer, the tube current of the cold-cathode tube is oscillated in some cases as shown in FIG. 8, depending of the input voltage to the piezoelectric transformer and its drive frequency. In FIG. 8, time is plotted as abscissa, and the tube current as ordinate. The high frequency component of this periodic waveform is the drive frequency of the piezoelectric transformer. The current flows as if the tube current is amplitude-modulated at a lower frequency than the drive frequency.

Japanese Unexamined Patent Publication Nos. 10-125970, 10-14448, and 10-150230 describes piezoelectric transformers and cold-cathode tube lighting devices of which the purpose lies in that the above-described abnormal oscillation of a tube current is prevented.

In the piezoelectric transformers and the cold-cathode tube lighting devices using the piezoelectric transformers described in the above-mentioned official gazettes, basically, a capacitor element is inserted between a terminal on the output side of a piezoelectric transformer and a cold-cathode tube, so that the output impedance of the piezoelectric transformer is effectively enhanced, and the tube current is stabilized. Such a method of stabilizing a tube current by insertion of a capacitor element is very effective. However, it is necessary to provide an additional capacitor element. Thus, there arises the problem that the number of components is increased, and the manufacturing process is complicated.

SUMMARY OF THE INVENTION

Accordingly, it is an object of the present invention to provide a piezoelectric transformer and a discharge lamp device, in which the tube current of a discharge tube such as a cold-cathode tube or the like is stabilized, and the piezoelectric transformer itself causes a stable tube current to flow through the discharge tube without need of inserting an additional capacitor element between a terminal on the output side of the piezoelectric transformer and the cold-cathode tube.

According to a first aspect of the present invention, a piezoelectric transformer for outputting a drive voltage to a discharge tube as a load is characterized in that the value obtained by dividing the output current of the piezoelectric transformer at a load resistance of about zero into the output voltage of the piezoelectric transformer at a load resistance of about infinity is set to be larger than about one-third of the maximum impedance of the discharge tube during discharging.

The reason of this requirement will be described in the embodiments. The output impedance of the piezoelectric transformer is defined as a value obtained by dividing the output current of the piezoelectric transformer at a load resistance of about zero into the output voltage at a load resistance of about infinity. The output characteristic of the piezoelectric transformer becomes approximately that of a constant current source by setting the above-defined output impedance of the piezoelectric transformer to be larger than about one-third of the maximum impedance of the discharge tube during discharging (during lighting in the case where the discharge tube is a cold-cathode tube), so that the tube current of the discharge tube is stabilized. When the discharge tube is a discharge lamp comprising a cold-cathode tube, the lighting condition is stabilized.

Preferably, the condition that the load resistance is about infinite is obtained under the condition that a capacitive load is connected in parallel to the piezoelectric transformer. For example, if the cold-cathode tube is incorporated into a panel unit for which measures against noise have been taken, it means that a capacitive load is equivalently connected to the piezoelectric transformer. The tube current in the practical use condition can be stabilized by determining the above-described output impedance including the capacitive load.

According to a second aspect of the present invention, the absolute value of the gradient of a change in output current of the piezoelectric transformer based on a change in output voltage thereof at an impedance substantially equivalent to the impedance of the discharge tube during discharging is set to be smaller than the absolute value of the gradient of a change in tube current of the discharge tube during discharging based on a change in tube voltage of the discharge tube during discharging.

The reason of this requirement will be also described in the embodiments. With the above-described configuration, a fluctuation in input source voltage to the piezoelectric transformer, if occurs, is prevented from significantly changing the tube current of the discharge tube. Thus, the tube current of the discharge tube is stabilized.

Preferably, the impedance of the discharge tube during discharging is the impedance of the discharge tube measured under the condition that a capacitive load is connected in parallel to the piezoelectric transformer. Thus, the tube current in the practical use condition can be stabilized.

BRIEF DESCRIPTION OF THE DRAWINGS

FIG. 7 is a graph showing the output characteristic of the piezoelectric transformer at the different input voltages as a parameter;

FIG. 8 is a graph showing the waveform of a tube current in the abnormal oscillation condition;

DESCRIPTION OF THE PREFERRED EMBODIMENT

The configurations of a piezoelectric transformer and a discharge lamp device according to embodiments of the present invention will be described with reference to FIGS. 1 to 12.

Figure 11A:
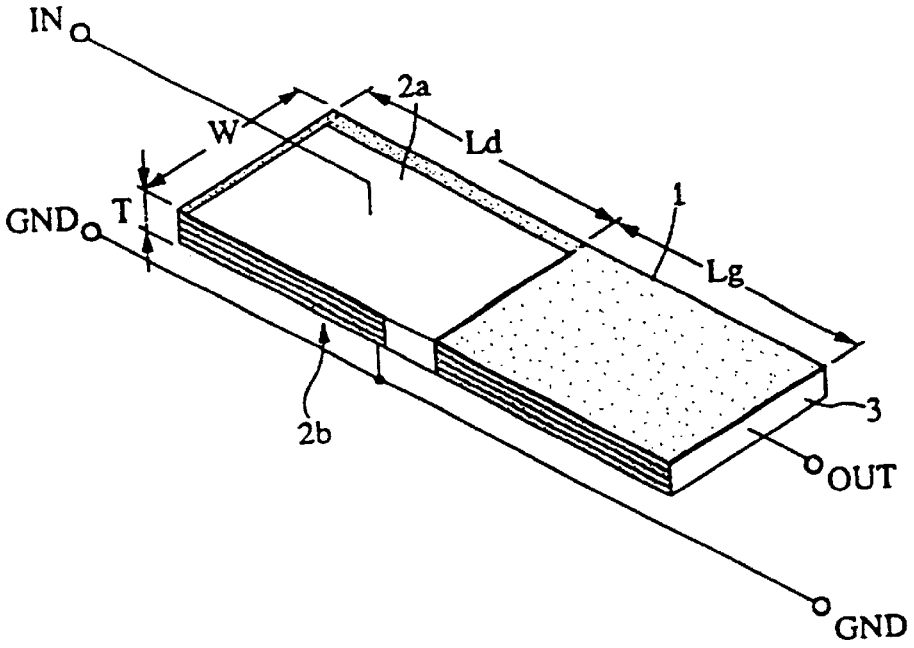
FIG. 11A PRIOR ART
FIGS. 11A and 11B illustrate the structure of the piezoelectric transformer.
Figure 11B:
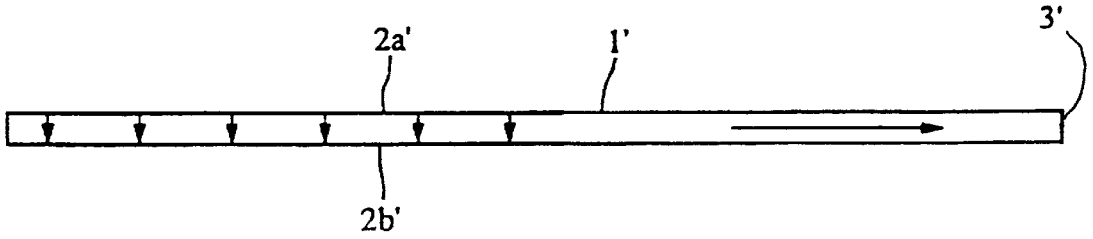
FIG. 11B PRIOR ART

FIGS. 11A and 11B show the configuration of the piezoelectric transformer. FIG. 11A is a perspective view of the transformer, and FIG. 11B is a side view showing the configuration of a piezoelectric sheet constituting one layer of the transformer. In FIG. 11A, a piezoelectric sheet laminate 1 is shown, the length Ld on the drive side is 10.4 mm, the length Lg on the power generation side is 7.6 mm (the overall length is 18 mm), the width W is 6 mm, and the thickness T is 1.6 mm. The number of the laminated layers in the drive section is 12. Thus, a Rosen type piezoelectric transformer is formed.

The arrows in FIG. 11B indicate the polarization direction of a piezoelectric sheet 1' constituting each layer of the laminate. Input-output electrodes 2*a*' and 2*b*' are positioned on the upper side and the underside of each of the laminated plural piezoelectric sheets. Further, an output electrode 3' is shown. The drive side of the piezoelectric sheet 1' which is sandwiched between the input electrodes 2*a*' and 2*b*' is polarized in the thickness direction of the piezoelectric sheet 1'. The remaining piezoelectric sheet 1' portion, that is, the power generation side is polarized in the longitudinal direction. The electrodes positioned on the upper sides of the respective laminated piezoelectric sheets and those positioned on the undersides thereof are connected in parallel, respectively and led out, as shown in FIG. 11A. Electrodes 2*a* and 2*b* shown in FIG. 11A are the input electrodes which appear on the outermost sides of the laminate.

With this structure, the sizes of the piezoelectric sheets are determined in such a manner that a substantially half-wavelength wave stands on the drive side (the portion corresponding to Ld), while a substantially quarter-wavelength wave stands on the power generation side (the portion corresponding to Lg), and as a whole, the piezoelectric transformer is vibrated at one wavelength or a half-wavelength.

Figure 12A:
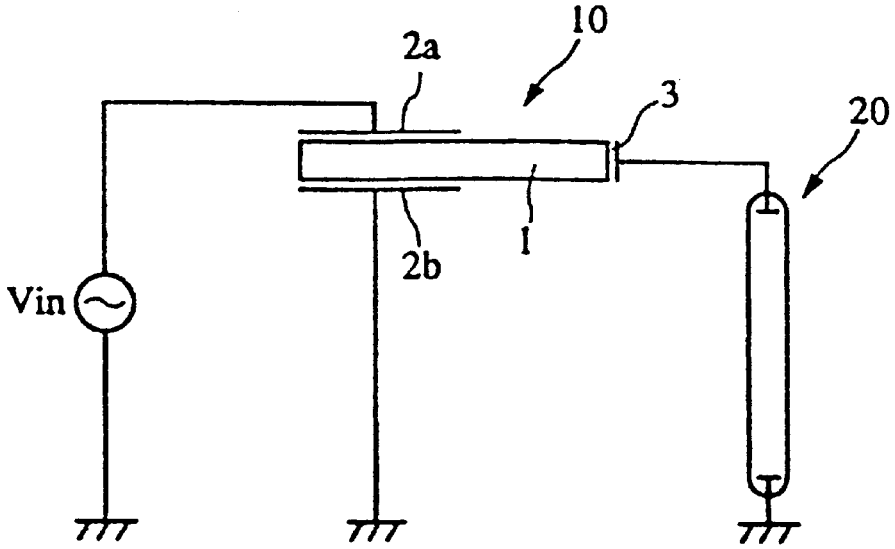
FIGS. 12A and 12B illustrate the configuration of the piezoelectric transformer and a discharge lamp device containing a discharge lamp.

FIG. 12 shows the configuration of a discharge lamp device using a discharge lamp comprising a cold-cathode tube and a piezoelectric transformer. In the example shown in FIG. 12A, an a.c. input voltage Vin is applied across input electrodes 2*a* and 2*b* of a piezoelectric transformer 10. A discharge lamp 20 comprising a cold-cathode tube is connected between an output electrode 3 and one 2*b* of the input electrodes.

Figure 12B:
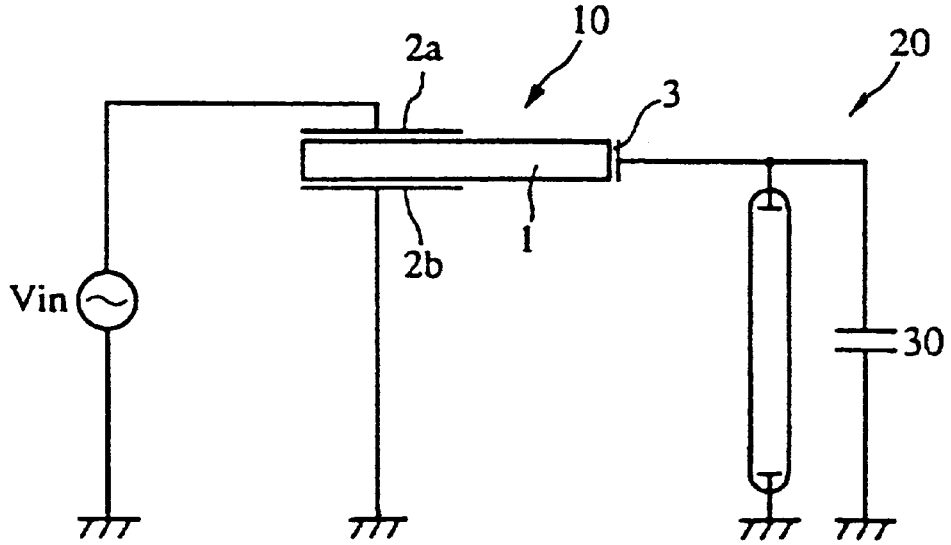

In the example shown in FIG. 12B, a capacitive load 30 is connected in parallel to the discharge lamp 20. The capacitive load 30 is not a discrete element. When the piezoelectric transformer and the cold-cathode tube are incorporated in a panel unit, and leakage (undesired radiation) of a noise electric field or a noise magnetic field into the outside is suppressed by means of the panel unit, the capacitive load 30 is equivalently generated, due to the panel unit.

Figure 1:
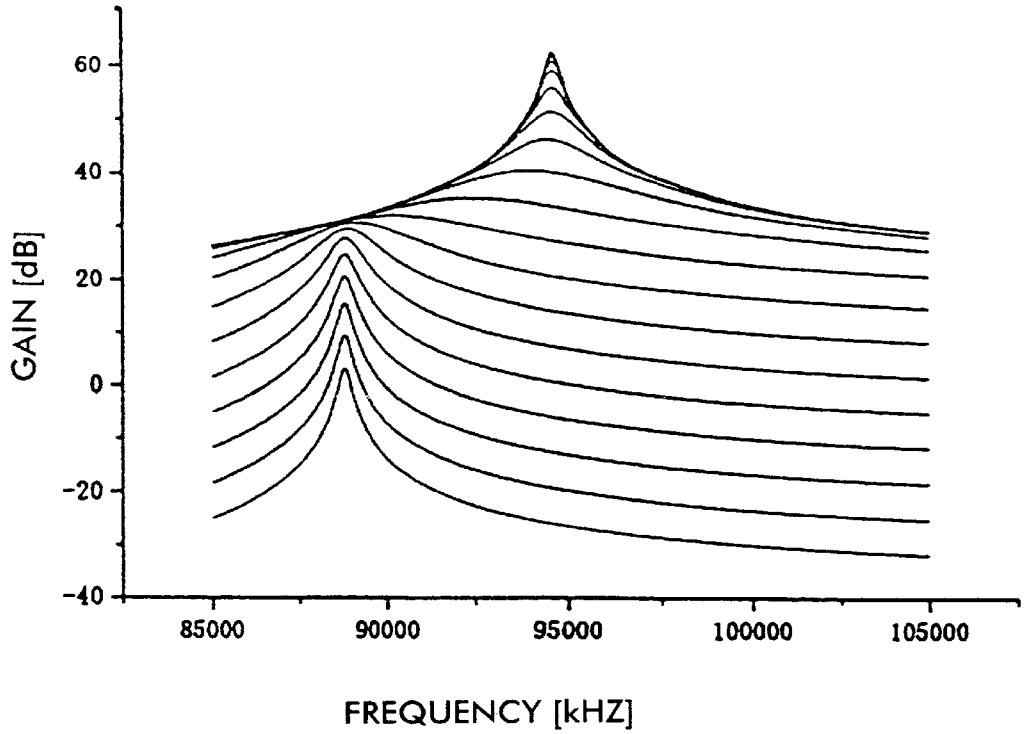
FIG. 1 is a graph showing the frequency characteristic of the boosting ratio at the different load resistances as a parameter of a piezoelectric transformer according to an embodiment of the present invention.

FIG. 1 is a graph showing a boosting ratio—frequency characteristic of the above-described piezoelectric transformer. The boosting ratio (gain) obtained when the frequency of an input voltage is varied at the different load resistances for the piezoelectric transformer as a parameter is expressed in the form of curves. The curve on the lowermost side in FIG. 1 represents the characteristic obtained when the load resistance is 100 Ω. The curve on the uppermost side represents the characteristic obtained when the load resistance is 100 MΩ. The plurality curves drawn between the uppermost and lowermost curves represent the characteristics obtained when the load resistances are in the range of 100 Ω to 100 MΩ. Hereupon, the load resistance is varied in such a manner that three characteristic curves can be drawn every time the load resistance is varied by one order of magnitude. In particular, the second curve from the bottom, the third curve, the fourth curve, the fifth curve, and the sixth curve are obtained when the load resistance is sequentially varied from $100\times10^{1/3}$ Ω, $100\times10^{2/3}$ Ω, 1 KΩ, and 1 $k\times10^{1/3}$ Ω, and so on.

As seen in FIG. 1, the frequency at a maximum boosting ratio is varied with the load resistance. In the range where the load resistances are low, the frequency at the maximum boosting ratio converges approximately on 88.8 kHz. In the high load resistance range, the frequency at the maximum boosting ratio converges approximately on 94.6 kHz.

The voltage—current characteristic of the output on the secondary side of the piezoelectric transformer can be determined by use of the curves shown in FIG. 1, on condition that the input voltage on the primary side of the piezoelectric transformer is constant. The characteristic is varied with the frequency. FIGS. 2 to 7 are graphs showing the respective output voltage—current characteristics obtained when the frequencies are 85.9 kHz, 88.8 kHz, 91.7 kHz, 94.6 kHz, 97.5 kHz, and 100.4 kHz.

In FIGS. 2 to 7, the output voltage—current characteristics of the piezoelectric transformer determined at the different input voltages on the primary side as a parameter are represented by the plurality continuous lines. Under ordinary use conditions, the boosting ratio of the piezoelectric transformer shows a substantially linear-form which is independent of the input voltage. Therefore, the curve (hereinafter, referred to as output characteristic, briefly)

representing the output voltage—current characteristic (hereinafter, referred to as output characteristic, briefly) of the piezoelectric transformer is changed similarly in shape with the input voltage on the primary side.

The output impedance of the piezoelectric transformer is defined as a value obtained by dividing a current at an output voltage of 0 (when the load resistance is about zero) into a voltage at a current of 0 (when the load resistance is about infinite) in the output characteristic of the piezoelectric transformer. Generally, an input impedance is defined as a ratio of a voltage applied to an output terminal to a current flowing through an output circuit. Accordingly, the definition of the output impedance used in the present invention is different from that of the general output impedance.

The above-described output impedance is varied with the shape and size of the piezoelectric transformer, an employed resonance mode, and moreover its drive frequency. The output impedances at the above-mentioned six drive frequencies are varied in a wide range, that is, are 30 kΩ, 2.6 kΩ, 87 kΩ, 2.8 MΩ, 230 kΩ, and 150 kΩ, as shown in FIGS. 2 to 7.

The curves drawn by broken lines in FIGS. 2 to 7 each represent the characteristic (hereinafter, referred to as the characteristic curve of a cold-cathode tube, briefly) of a change in tube current to a change in tube voltage of the cold-cathode tube with a length of 250 mm and an outer diameter of 2.6 mm. Cold-cathode tubes of this class are used at a tube current of about 1.5 to 6 mA. Therefore, the equivalent impedance (tube voltage/tube current) is varied in the range from about 110 kΩ to about 500 kΩ. The intersection points of the characteristic curves of the cold-cathode tube shown by the broken lines and the output characteristic curves of the piezoelectric transformer shown by the continuous lines correspond to the operating points during lighting.

Figure 3:
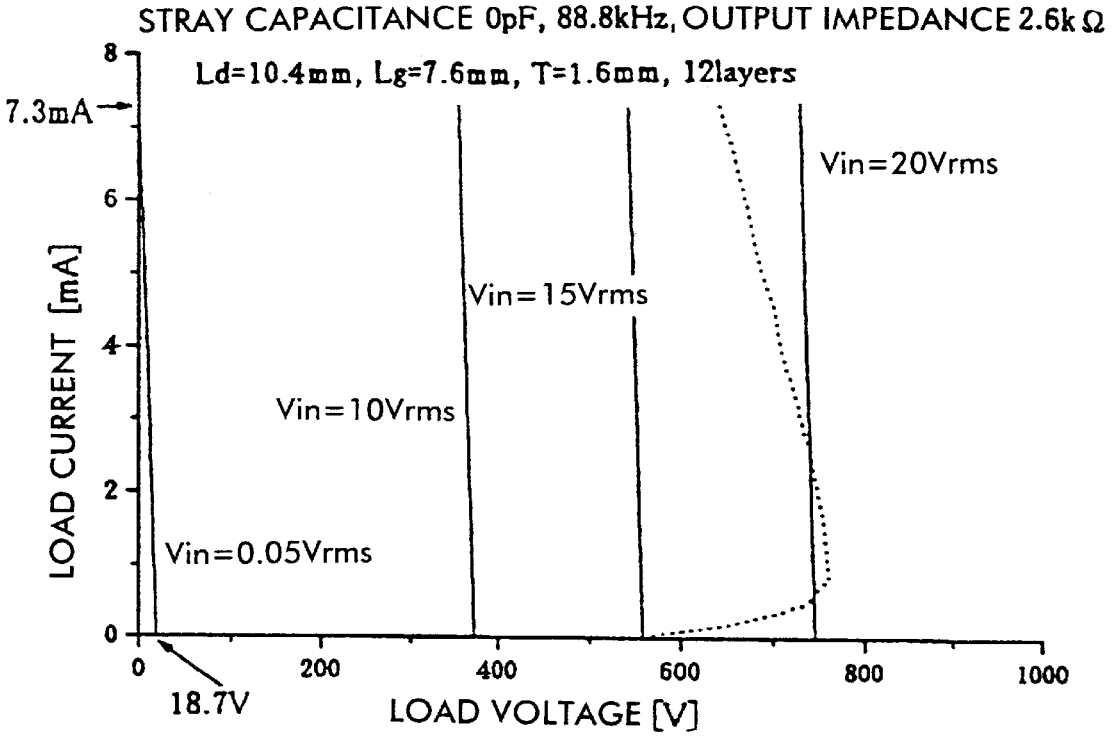
FIG. 3 is a graph showing the output characteristic of the piezoelectric transformer at the different input voltages as a parameter.

When the drive frequency is 88.8 kHz, that is, the output impedance of the piezoelectric transformer is low, namely, 2.6 kΩ, as shown in FIG. 3, the piezoelectric transformer on the secondary side presents a substantially constant voltage source operation. On the other hand, the characteristic curve of the cold-cathode tube has a relatively large negative gradient, that is, has a negative resistance characteristic. Accordingly, especially in the large current range (in the range where the continuous line lies on the right-hand side of the broken line in the graph), the output voltage of the piezoelectric transformer is higher than the tube voltage of the cold-cathode tube. Therefore, the tube current of the cold-cathode tube is unstable and uncontrollable.

Figure 2:
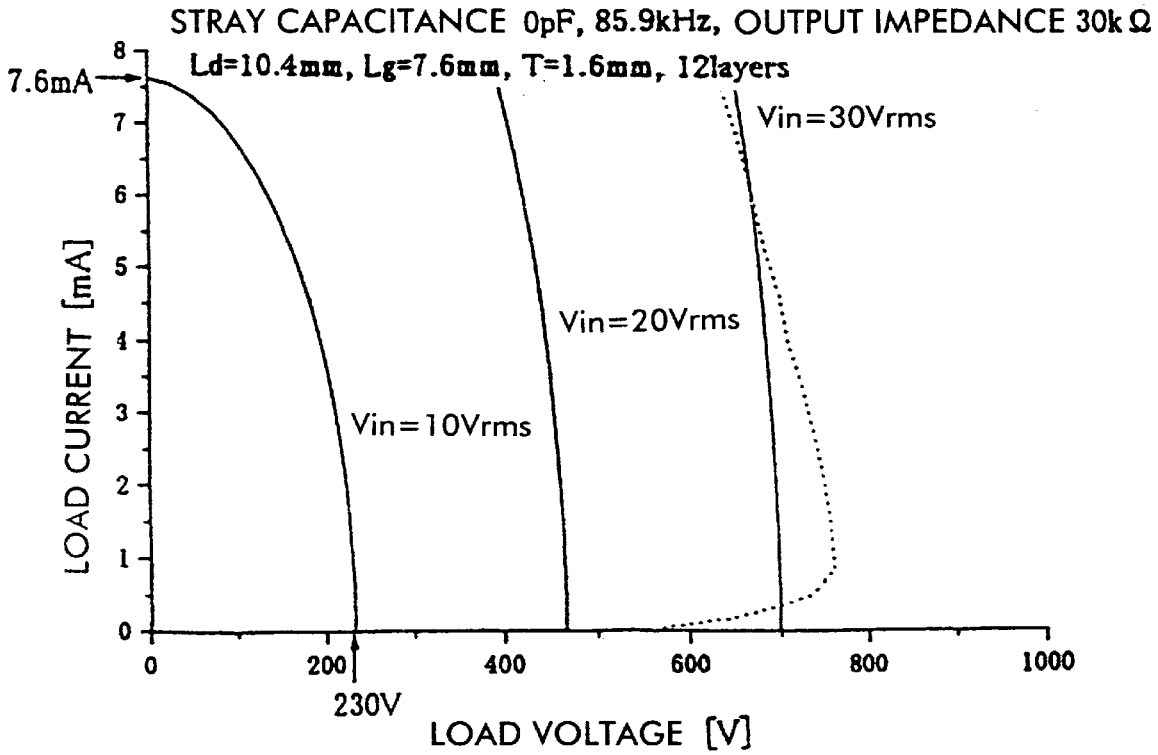
FIG. 2 is a graph showing the output characteristic of the piezoelectric transformer at the different input voltages as a parameter.

When the drive frequency is 85.9 kHz, that is, the output impedance of the piezoelectric transformer is 30 kΩ, as shown in FIG. 2, the output characteristic curve of the piezoelectric transformer and the characteristic curve of the cold-cathode tube have two definite intersection points at an input voltage Vin of 30 V. In other words, there are two stable operating points, which causes unstable abnormal oscillation as shown in FIG. 8.

Figure 4:
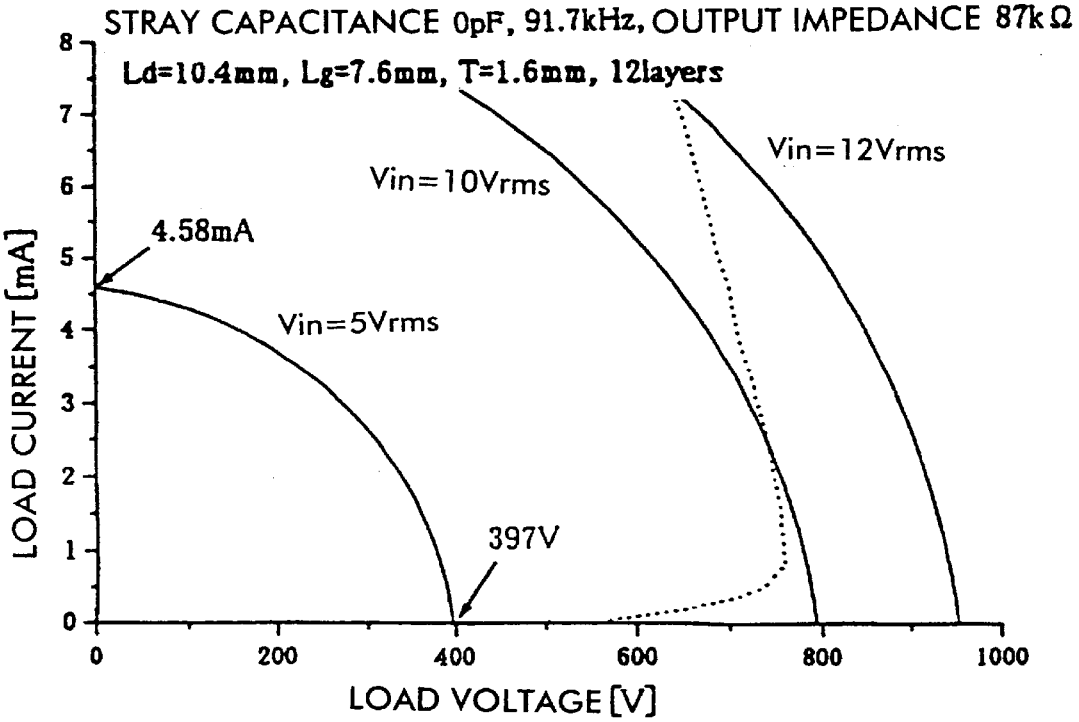
FIG. 4 is a graph showing the output characteristic of the piezoelectric transformer at the different input voltages as a parameter.

When the drive frequency is 91.7 kHz, that is, the output impedance of the piezoelectric transformer is 87 kΩ, as shown in FIG. 4, there is one operating point. However, since the output characteristic curve of the piezoelectric transformer has a gradient similar to that of the characteristic curve of the cold-cathode tube, even fine fluctuation in input voltage to the piezoelectric transformer causes the tube current to change considerably. For this reason, the lighting condition tends to become unstable.

On the other hand, as shown in FIG. 7, when the drive frequency is 100.4 kHz, that is, the output impedance of the piezoelectric transformer is 150 kΩ, there is one operating point, and the absolute value of the gradient of the output characteristic curve of the piezoelectric transformer is sufficiently smaller than that of the characteristic curve of the cold-cathode tube. Therefore, the lighting condition is stable.

Figure 5:
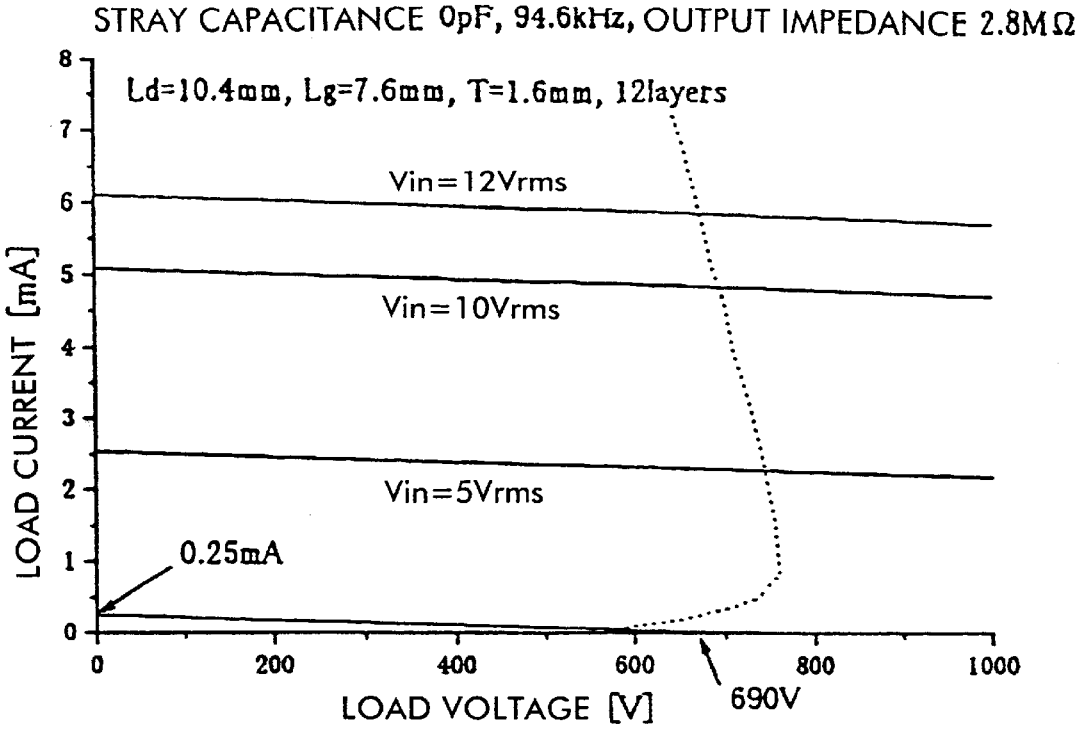
FIG. 5 is a graph showing the output characteristic of the piezoelectric transformer at the different input voltages as a parameter.
Figure 6:
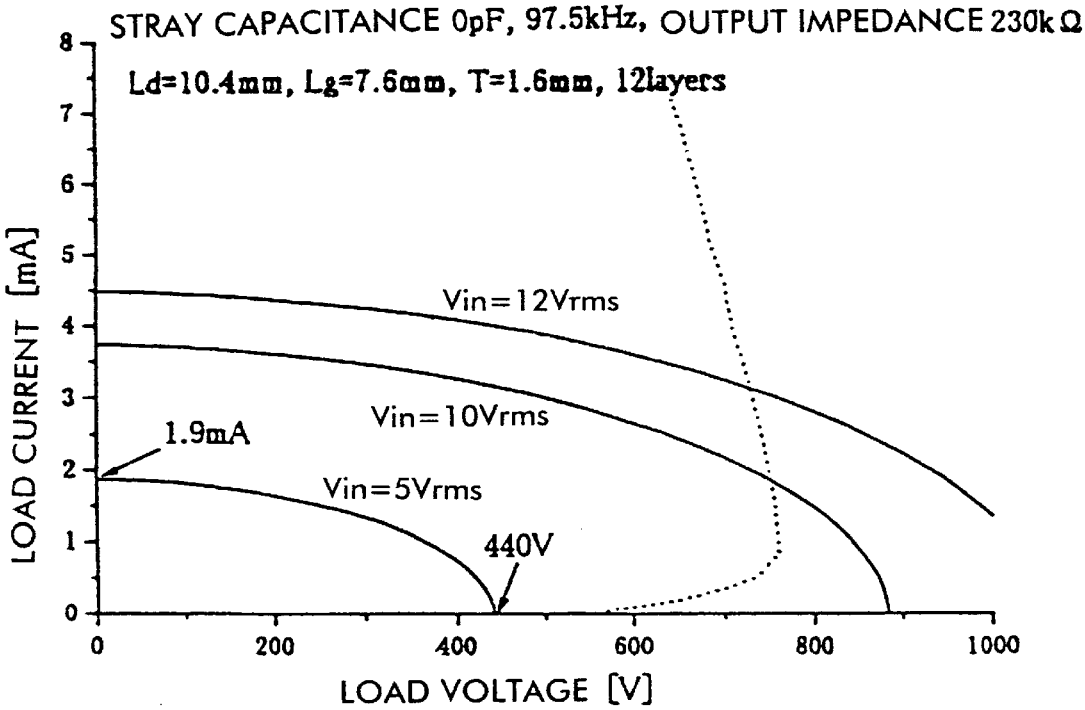
FIG. 6 is a graph showing the output characteristic of the piezoelectric transformer at the different input voltages as a parameter.

FIGS. 5 and 6 illustrate the cases in which the output impedance of the piezoelectric transformer is higher than the above-mentioned value, namely, 150 kΩ. In these cases, the output characteristic of the piezoelectric transformer becomes nearly the same as that of the constant current source, and the lighting condition becomes more stable.

The tube current can be prevented from being uncontrollable by setting the drive frequency or the like in such a manner that absolute value of the gradient of the output characteristic curve of the piezoelectric transformer is smaller than that of the cold-cathode tube. Stable lighting condition can be achieved by setting the absolute value of the gradient of the output characteristic curve of the transformer to be sufficiently small.

In the above-described examples, the stable lightening condition can be attained by setting the output impedance of the piezoelectric transformer to be more than 150 kΩ. The maximum impedance in the practical use of the cold-cathode tube is about 500 kΩ. Accordingly, sufficiently stable lighting condition eliminating uncontrollable condition and abnormal oscillation can be obtained by setting the output impedance of the piezoelectric transformer to be at least about one-third of the maximum impedance of the cold-cathode tube.

In the above-described examples, the output impedance of the piezoelectric transformer is changed by changing the drive frequency of the piezoelectric transformer, and the lighting condition at each output impedance is discussed. However, it is understood that the present invention doesn't intend to limit the drive frequency of the piezoelectric transformer. According to the present invention, the stable discharge condition of a cold-cathode tube is obtained from the viewpoints of the output impedance of the piezoelectric transformer defined previously and the maximum impedance of the cold-cathode tube during discharging. The maximum impedance of the cold-cathode tube is varied with the size of the cold-cathode tube and the environmental conditions such as temperature range or the like. Accordingly, it is recommended that the maximum impedance of the cold-cathode tube during discharging is estimated, and based on the estimation, the characteristic of the piezoelectric transformer and its drive frequency are determined.

Next, a piezoelectric transformer according to a second embodiment and a discharge lamp device will be described.

When a piezoelectric transformer and a cold-cathode tube are incorporated into a panel unit, formed is a circuit in which a capacitive load is connected in parallel to the cold-cathode tube as shown in FIG. 12B, caused by a stray capacitance or the like. In the case where such a capacitive load is present, the output impedance of the piezoelectric transformer is set to be more than about one-third of the maximum impedance of the cold-cathode tube during discharging, including the capacitive load. Moreover, the characteristics of the piezoelectric transformer, the characteristics of the cold-cathode tube, and the drive conditions of the piezoelectric transformer are determined in such a manner that the absolute value of the gradient of the output characteristic curve of the piezoelectric transformer is smaller than that of the cold-cathode tube during discharging.

Examples of the output characteristic curve of the piezoelectric transformer, obtained by use of the above-mentioned piezoelectric transformer and when the static capacitance of the capacitive load is changed to 10 pF and 20 pF, respectively, will be shown below.

| | 85.9 kHz | 88.8 kHz | 91.7 kHz | 94.6 kHz | 97.5 kHz | 100.4 kHz |
|---|---|---|---|---|---|---|
| 0 pF | 30 kΩ | 2.6 kΩ | 87 kΩ | 2.8 kΩ | 230 kΩ | 150 kΩ |
| 10 pF | 26 kΩ | 2.6 kΩ | 173 kΩ | 167 kΩ | 97 kΩ | 78 kΩ |
| 20 pF | 23 kΩ | 2.6 kΩ | 779 kΩ | 84 kΩ | 61 kΩ | 52 kΩ |

Figure 10:
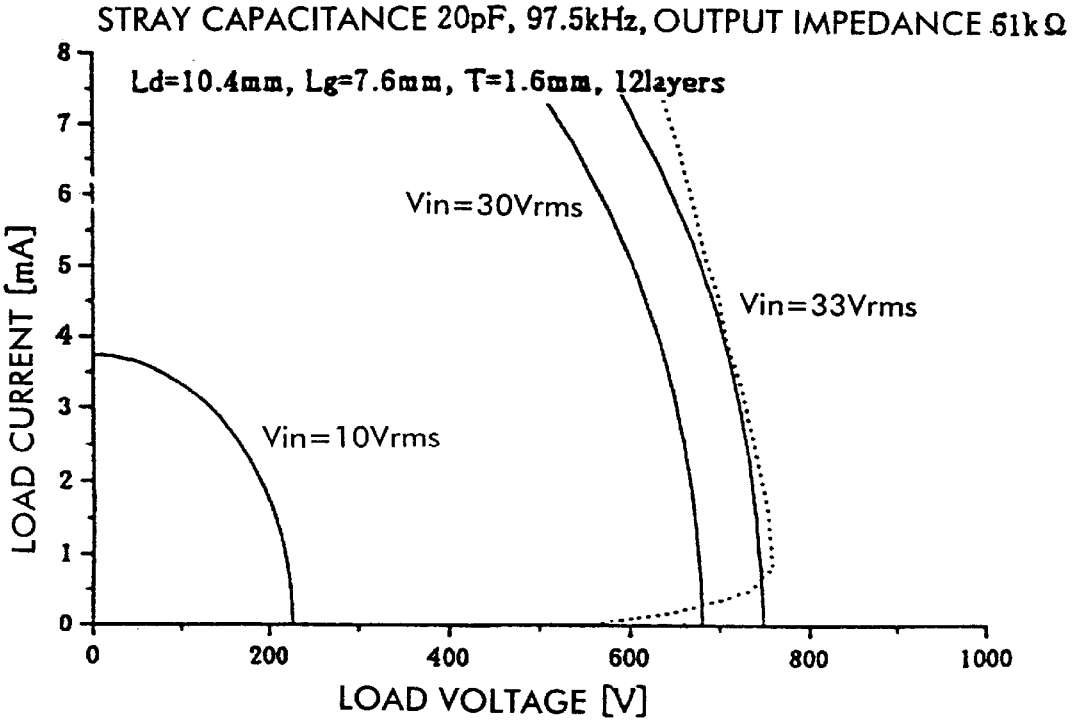
FIG. 10 is a graph showing the output characteristic of the piezoelectric transformer at the different input voltages as a parameter under the condition that a stray capacitance is present.

FIG. 10 shows the output characteristic curve of the piezoelectric transformer obtained when the stray capacitance is 20 pF, and the piezoelectric transformer is driven at 97.5 kHz. Hereupon, the output impedance of the piezoelectric transformer including the stray capacitance is 61 kΩ. In this case, since the absolute value of the gradient of the output characteristic curve of the piezoelectric transformer including the stray capacitance is nearly equal to that of the cold-cathode tube, even fine-fluctuation in input voltage to the piezoelectric transformer causes the tube current to vary considerably. For this reason, the lighting condition is unstable, and the tube current becomes uncontrollable.

Figure 9:
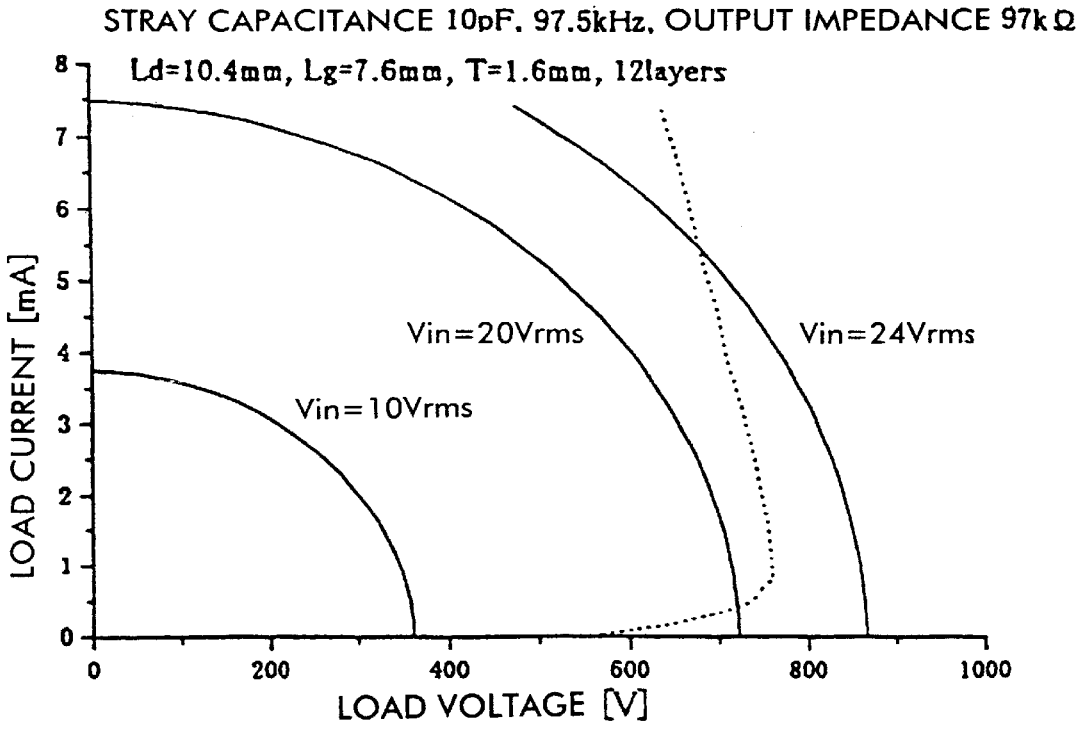
FIG. 9 is a graph showing the output characteristic of the piezoelectric transformer at the different input voltages as a parameter under the condition that a stray capacitance is present.

On the other hand, FIG. 9 shows the output characteristic curve of the piezoelectric transformer when the stray capacitance is 10 pF, and the piezoelectric transformer is driven at 97.5 kHz. The output impedance of the piezoelectric transformer including the stray capacitance is 97 kΩ. This value is lower than one-third of the maximum impedance of the cold cathode tube during lightening. However, since the absolute value of the gradient of the output characteristic curve of the piezoelectric transformer including the stray capacitance is smaller than that of the cold-cathode tube, sufficiently stable lighting condition without uncontrollable state and abnormal oscillation can be obtained.

In the above-described examples, as the discharge tube, a cold-cathode tube is described. In general, the present invention can be applied to a discharge tube presenting a negative resistance characteristic and a substantially constant voltage characteristic.

According to a first aspect of the present invention, the output characteristic of the piezoelectric transformer becomes substantially that of a constant-current source. Thus, the tube current of the discharge tube is stabilized.

According to a second aspect of the present invention, a fluctuation in input source voltage for the piezoelectric transformer, if occurs, is prevented from changing the tube current of the discharge tube significantly. The tube current is stabilized.

Preferably, by incorporating a cold-cathode tube into a panel unit for which measures against noise have been taken, for example, the capacitive load is equivalently connected in parallel to the piezoelectric transformer. Thereby, the tub current in the practical use condition can be stabilized.

Further, even if fluctuations in input voltage for he piezoelectric transformer and its drive frequency occur, stable lighting condition can be obtained.

What is claimed is:

1. A piezoelectric transformer for outputting a drive voltage to a discharge tube as a load, wherein a value obtained by dividing an output current of the piezoelectric transformer at a load resistance of about zero into an output voltage of the piezoelectric transformer at the load resistance of about infinity is set to be larger than about one-third of the maximum impedance of the discharge tube during discharging; and the condition that the load resistance is about infinity is obtained under the condition that a capacitive load is connected in parallel to the piezoelectric transformer.

2. A piezoelectric transformer for outputting a drive voltage to a discharge tube as a load, wherein an absolute value of the gradient of a change in output current of the piezoelectric transformer based on a change in output voltage thereof at an impedance substantially equivalent to an impedance of the discharge tube during discharging is set to be smaller than the absolute value of the gradient of a change in tube current of the discharge tube during discharging based on a change in tube voltage thereof during discharging; and the impedance of the discharge tube during discharging is an impedance measured under the condition that a capacitive load is connected in parallel to the piezoelectric transformer.

3. A discharge lamp device containing the discharge tube as a discharge lamp comprising a cold-cathode tube, said discharge lamp being connected to the output of the piezoelectric transformer defined in any one of claim 1 or 2.

4. A piezoelectric transformer for outputting a drive voltage to a discharge tube as a load, wherein an output impedance of the transformer is set to be equal to about one-third of the maximum impedance of the discharge tube during discharging, the output impedance being equal to an output current of the transformer at a load resistance of about zero divided by an output voltage of the transformer at a load voltage of about infinity, the load voltage of about infinity being determined with a capacitive load being connected in parallel with the piezoelectric transformer.

* * * * *